US005675905A

United States Patent [19]

Hougham

[11] Patent Number: 5,675,905

[45] Date of Patent: Oct. 14, 1997

[54] DRYER SYSTEM FOR VEGETABLES

[75] Inventor: John Hougham, Carmel, Calif.

[73] Assignee: The Great Northern Equipment Company LLC, Carmel, Calif.

[21] Appl. No.: 662,661

[22] Filed: Jun. 14, 1996

[51] Int. Cl.[6] ..... F26B 17/24

[52] U.S. Cl. ..... 34/58; 99/483; 494/33; 210/361; 210/781

[58] Field of Search ..... 34/318, 322, 58, 34/60; 99/483, 511; 494/33, 36; 210/781, 361

[56] References Cited

U.S. PATENT DOCUMENTS

| | | | |
|---|---|---|---|
| 2,452,638 | 11/1948 | Drum et al. | 34/58 |
| 3,447,544 | 6/1969 | De Vergara | 134/60 |
| 4,310,119 | 1/1982 | Culhane et al. | 210/361 X |
| 4,493,156 | 1/1985 | Siegmann | 34/58 X |
| 5,027,530 | 7/1991 | Vollmer et al. | 34/58 |
| 5,212,876 | 5/1993 | Berit | 34/58 |
| 5,282,319 | 2/1994 | Casquilho et al. | 34/58 X |

FOREIGN PATENT DOCUMENTS 2421568 11/1979 France .

*Primary Examiner*—John M. Sollecito
*Assistant Examiner*—Steve Gravini
*Attorney, Agent, or Firm*—Flehr Hohbach Test Albritton & Herbert LLP

[57] ABSTRACT

An apparatus and method for the drying of produce and particularly leafy vegetables. A spin dryer (100) is provided which releasably receives and holds a plurality of manually liftable field baskets (21). A turntable assembly (110) is rotatably mounted to a stationary support structure (105) and operatively coupled to a drive assembly (121). Turntable (110) is adapted to hold a plurality of baskets (21) preferably with the baskets (21) positioned on their sides with their perforated bottom walls (24) facing outwardly and away from the turntable spin axis (14). Produce pieces (22) are preferably stacked in baskets (21) in a parallel vertical orientation with their stems (31) proximate the bottom walls (24) of the baskets (21). When the baskets (21) are placed on the turntable (110) on their sides, the baskets (21) reorient the produce pieces (22) to parallel horizontal planes which are perpendicular to the spin axis (114) for efficient water ejection and for support of the produce pieces (22) on their stems (31). A method of centrifugal drying of produce also is disclosed in which the produce pieces (22) are placed in a product basket (21) and the basket is mounted to a turntable (110), while the produce (22) remains in the basket (21), for centrifugal drying while in the field basket.

15 Claims, 4 Drawing Sheets

DRYER SYSTEM FOR VEGETABLES

TECHNICAL FIELD

In general, the present invention relates to produce drying systems and, more particularly, this invention relates to methods and apparatus for drying vegetables and particularly leafy vegetables.

BACKGROUND ART

1. Drying Systems for Vegetables

In the field produce and particularly vegetables are typically harvested or gathered and placed into containers called baskets, totes, crates, cartons, or bins (hereafter collectively referred to as "baskets") for further processing. Such baskets can be relatively small and capable of being lifted and otherwise manually manipulated by a single worker or they can be of a size which can only be lifted by a machine. The produce is sometimes placed in these baskets in a random orientation and is sometimes stacked into the baskets in a uniform orientation. In either case, the produce is not processed further in the field packing baskets and is merely transported to a central location where they are removed from the baskets and processed, i.e., washed, dried, packaged, cooled, stored, and then shipped.

As a result of the above processing, produce undergoes a significant amount of handling during the period of time from which it is first harvested until it is finally displayed for sale. This transferring of the produce from machine to machine and container to container can result in significant damage and degrading of the produce and makes it less appealing to the consumer visually. In addition, the shelf-life of produce is also reduced when it has been subjected to excessive handling. Moreover, cellular damage to produce in turn results in the loss of cellular fluids and in an increased risk of microbiological decay. Furthermore, the lengthy process of repetitive transferring of produce among various containers and various machines expends a significant amount of time and labor, thereby increasing its eventual cost.

Consequently, the need exists for a drying system for produce, and particularly vegetables, in which the vegetables need not be excessively handled from the initial gathering in the field until their subsequent marketing. Rather, it would be preferable to use a single container to hold the vegetables from the time they are harvested until the time they are ready for packaging.

2. Specific Prior Art Systems

Various systems for drying of produce are well known, and some systems also are capable of both washing and drying produce. An example of such a system is U.S. Pat. No. 3,447,544 to De Vergara detailing a machine for the washing and drying of fruit. This machine accepts individual fruit into an opening at one end and proceeds to send these fruit through a pressurized washing bath. This is followed by the individual fruit passing into a hydro-refrigeration chute which is then finally followed by a air blower which dries the fruit. The fruit are individually placed into the washing and drying device and individually removed from the device, without the use of baskets or similar containers for compartmentalizing the fruit.

The use of centrifugal spin dryers for drying produce, and particularly leafy vegetables, is also well known. All of the prior art spin dryer systems, however, suffer from the fundamental limitation that they do not accommodate the use of field harvesting baskets in their drying processes. A second major limitation of these systems is that the leaves of the vegetables are randomly oriented in the dryer which impedes the centrifugal drying process by trapping moisture in the leaves and increases leaf damage.

U.S. Pat. No. 4,493,156 to Siegmann discloses a spin dryer into which produce, often leafy produce such as lettuce, cabbage or the like, is first loaded from above the dryer by way of an input conveyor. The produce falls randomly into a cylindrical-shaped perforated container which is then spun to produce the drying effect. The dried produce is then unloaded by way of a vertically displaceable lower wall member, which drops away such that the dried produce falls onto a pair of belt conveyors. U.S. Pat. No. 5,212,876 to Berit discloses a spin dryer similar to Siegmann, in which randomly oriented produce is loaded through a vertical chute and unloaded by a moving conical bottom wall which drops away from the bottom of the dryer, with the produce falling onto a moving conveyor. U.S. Pat. No. 5,282,319 to Casquilho, et al. discloses a basket for vegetable spin drying. In this device, a large basket is filled with randomly oriented vegetable produce which is hoisted up from the ground and lowered into a tank containing a rotatable platform. The basket is centered and fastened to this platform which is then rotated producing the drying effect. After the produce has been spun dry, the basket is then hoisted up and out of the tank. The basket has a bottom trap door which is released allowing the leafy produce to fall out of the basket.

None of these above drying systems are designed to employ a basket or baskets of the size used in field harvesting. As such, they all are bulk, random dryers and require repeated handling of the vegetable produce both when it is removed from the field harvesting baskets or containers to be placed in the spin dryer, and also when it is removed from the large spin dryer basket and placed into packing containers for shipment to market. This handling of the product, which can be quite violent as the product is dropped into, or out of, the spin dryer, will tend to degrade leafy produce. The produce will be damaged even further by its random orientation within the spin drying cylinder due to centrifugal force on the randomly oriented leaves.

Consequently, a long-felt need exists for a system to dry produce, and particularly leafy vegetables, without excessively handling and damaging the same. Such a system would allow harvested vegetables to remain in the field harvesting baskets in which they were first gathered, or if bulk harvested, would allow them to be placed once in processing baskets and left there during both the washing and drying processes. Such a system also would advantageously provide a drying process that is more effective and efficient in driving out water, with attendant savings in time and costs.

3. Objects of the Invention

It is an object of the present invention to provide an apparatus and method for the drying of produce, and particularly leafy vegetables.

It is another object of the present invention to provide a system for drying leafy vegetables which minimizes the amount of handling of the vegetables from the time which they are first gathered in the field through to their subsequent washing and drying processes.

It is a further object of the present invention to provide a system for drying vegetables which is adapted to allow the vegetables to remain in field or processing plant baskets during the drying operation.

It is a further object of the present invention to provide a system for drying vegetables that is adapted to employ manually manipulatable baskets which can be used for field harvesting or processing plant washing and drying.

It is a further object of the present invention to provide a method and apparatus for drying vegetables which is designed to take advantage of the generally uniform orientation of vegetable leaves as they are typically found when the vegetables are harvested and first placed into packing baskets.

DISCLOSURE OF THE INVENTION

The present invention provides an apparatus and method for drying vegetables while said vegetables remain in their field or processing plant packing baskets throughout the entire process.

The apparatus for centrifugal drying of the present invention is comprised, briefly, of a plurality of produce baskets each having a size sufficiently small to be lifted by a single worker when filled with produce and each having a perforated wall; a stationary support structure; a turntable assembly rotatably mounted to the support structure for rotation about a spin axis, said plurality of produce baskets being mounted on and releasably secured to said turntable assembly with said perforated wall of each of said produce baskets oriented to face away from said spin axis; and a drive assembly operably coupled to rotate said turntable assembly.

During the drying, the produce is preferably stacked in a predetermined orientation in the produce baskets, namely, with a length dimension of the pieces of produce substantially perpendicular to the perforated wall for the flow of water along the pieces and out the perforated wall. The perforated wall of each basket is most preferably the bottom wall and the produce baskets are preferably mounted to the turntable on their sides. The spin dryer also is optionally able to hold a plurality of vertically stacked baskets, thus drying larger quantities of vegetables simultaneously. An optional containment tank surrounds the dryer such that when water is forced out of the bottom of the baskets by the centrifugal force, it is prevented from merely spraying haphazardly in all directions.

In another aspect of the present invention, a method of drying produce is provided which is comprised of the steps of placing pieces of produce in a produce basket having a size suitable for lifting by a single worker and formed with a perforated wall; thereafter and while said pieces of produce are contained in said produce basket, releasably securing said produce basket to a turntable assembly for rotation of said produce basket about a spin axis with the perforated wall facing away from the spin axis; and thereafter rotating said turntable assembly with the produce basket secured thereto. In the most preferred form, a plurality of produce baskets are releasably secured to the turntable assembly during the securing step. The method further preferably is accomplished by placing the pieces of produce in the produce basket in a stacked, generally parallel, orientation which is substantially perpendicular to the perforated wall. Moreover, in the present method, the perforated wall is preferably the bottom wall of the produce basket, and during the securing step, the produce basket is preferably secured to the turntable assembly by resting the produce basket on a side wall on the turntable assembly.

BEST MODE OF CARRYING OUT THE INVENTION

Figure 1:
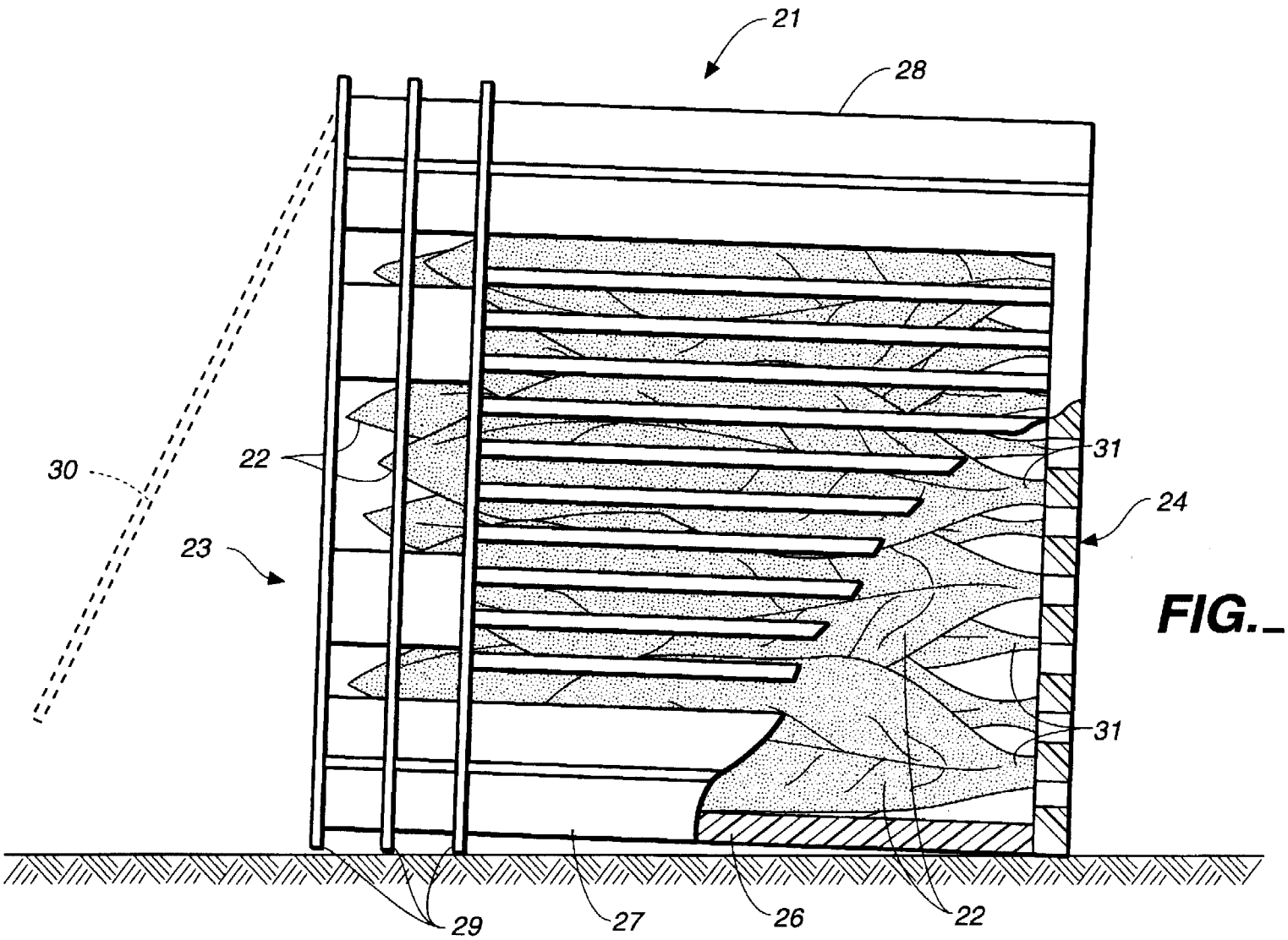
FIG. 1 is a side elevation view of a produce basket suitable for use in the dryer of the present invention, shown resting on a side thereof and partially broken away.

In the field, produce is often harvested by hand and hand-placed into field packing produce baskets. FIG. 1 shows a typical construction for such field-harvested produce baskets, generally designated 21. Produce basket 21 will usually have a size which is sufficiently small to enable a single worker to lift the basket when filled with produce. This allows the worker to manually manipulate the basket in the field, as needed, to fill the same with pieces 22 of produce and to load the filled basket onto a field transport tractor, trailer or the like.

Baskets 21 are typically rectangular in shape and formed of a molded plastic. Produce basket 21 has an open top 23, perforated bottom wall 24 and usually has open or perforated side walls 26, 27 and 28. A plurality of transversely extending ribs 29 are provided proximate open top 23 to reinforce the basket and provide a gripping and handling structure on the basket. Optionally, a pivotally mounted closure member or lid 30 can be provided, but for harvesting leafy vegetables such lids are usually not present.

Basket 21 is well known in the industry, and does not, by itself, constitute a novel structure of the present invention. Such packing baskets are commercially available, for example, from Buckhorn, Inc. of Milford, Ohio and are sold under the trademark BUCKHORN baskets. A typical produce basket for harvesting leafy vegetables will have a width of about 20 inches, a length of about 24 inches and a height of about 13 inches.

In other harvesting operations, the produce is gathered in much larger machine-lifted baskets, but, even when large totes or baskets are used in the field, baskets 21 often are used in processing plants to facilitate handling of batches or produce between washers, dryers and packing equipment. Whether used in field harvesting or in produce processing facilities, or even commercial kitchens, baskets 21 have heretofore been relegated to produce transport, and have not been used during the processing of the produce, that is, during the washing and drying of the produce.

Depending upon the produce being harvested, the pieces 22 will be either randomly oriented in baskets 21 or stacked in a substantially uniform predetermined orientation. The apparatus of the present invention is particularly well suited for use with leafy vegetables, and it is a feature of the present invention that pieces 22 of produce be placed in baskets 21 in a predetermined orientation. Thus, as shown in FIG. 1, leafy produce pieces 22 are preferably placed in basket nested relation with a longitudinal axis thereof running from perforated bottom wall 24 toward open end 23. Thus, produce pieces, such as leaf lettuce, can be stacked together with stems 31 proximate bottom perforated wall 24 and the leaf surface to be washed and dried extending perpendicular to wall 24 and open top 23.

Such field stacking of leaf vegetables in produce baskets is generally known in the industry as a way of efficiently filling the produce baskets and minimizing damage in the field.

Typically, the gathered leafy vegetables are sent to a central processing facility as stacked in baskets 21 for washing and drying. A variety of different methods have been used to wash and dry these vegetables; however, they have all required that the vegetables be removed from field containers 21 before either the washing or drying processes can begin. Often the vegetables are transferred between field baskets to bulk containers during these processes and then are removed from the bulk container and transferred to washing and drying apparatus and finally to a packing station.

All of this transferring of vegetables into and out of baskets and between processing equipment is compounded by the fact that the produce is typically not contained in protective containers of any sort during the actual washing and drying processes. Such excessive handling of the produce has significant detrimental effects on the quality of the finished product. Excessive handling damages produce, particularly since the cellular tissue of the produce tends to be quite fragile. Tears or rips in vegetable leaves, for example, will result in cellular fluid losses and an increased opportunity for microbiological infection, decay and damage. This reduces the shelf-life of the produce. Furthermore, at a minimum, the excessive handling of produce will cause bruising which makes the final product unattractive to consumers.

Present systems of washing and drying produce also tend to tear and injure the produce due to the simple fact that the produce is are typically dropped, while randomly oriented, from some height into the washer and the dryer and is also dropped from, again, while randomly oriented, when removed from the produce dryer, typically falling to a conveyor belt below.

The present invention significantly reduces produce handling and attendant handling and processing damage by providing a system in which the produce can be dried while still in produce baskets 21 in which they were placed, either in the field or in the processing plant. Produce baskets 21 were chosen as the ideal container for the produce, and particularly leafy vegetables in the present system since these baskets are conventionally used when first harvesting the produce in the field or first removing the harvested produce from bulk containers in the processing facility.

The apparatus and method of the present invention are designed to provide a system for highly efficient drying of the produce in the same orientation as it conventionally has been placed in baskets 21 in the field or in the processing facility.

The apparatus and method of the present invention enable drying of produce. It will be understood, however, that the drying step in produce processing is usually preceded by a washing step. The present apparatus and method are most advantageously employed with an integrated washing and drying process in which pieces of produce 22 never leave the produce basket in which they are placed in the field during washing or drying right up to the point at which they are placed directly from field packing baskets 21 into shipping and marketing cartons.

The washing apparatus which can be used with the centrifugal drying apparatus of the present application will be described in detail in a separate application. Suffice it to say that produce reaching dryer 100 of the present application has been thoroughly washed while in produce baskets 21, and the task of the present dryer is to dry the produce by an amount sufficient for transport to market.

The use of centrifugal or spin dryers for drying vegetables is well known. The problem with prior art produce dryer systems has been that they are not adapted to dry produce while contained in produce baskets 21. As such, the vegetables must first be removed from baskets 21 before they are placed in a washer or a spin dryer. Prior art dryer systems expended considerable energy removing vegetables from their original baskets, or from washing containers, before they could be spun dried. In addition, the vegetables placed into conventional spin dryers are randomly oriented and the centrifugal forces during the spin drying tended to damage the produce, and the random orientation slows or impedes the escape of trapped water from the produce.

In the present invention, not only are the field-packing produce basket 21 used in the apparatus and method, but the stacking of produce pieces 22 in baskets 21 in a uniform or common orientation is also employed. Placing produce pieces in a stacked relationship perpendicular to perforated bottom wall 24 is done in the field primarily for compactness. Orienting stems 31 of leafy produce downwardly against bottom wall 24 further is primarily a matter of supporting the leaves against gravity in an orientation similar to that when they are on the plant, that is, the natural leaf strength is to support the foliage by the butt of stem 31.

In the present invention, this field packing orientation is employed in the present dryer to make the drying off of water from the produce more efficient, and it is also employed to support the leaf more efficiently against centrifugal forces.

Figure 2:
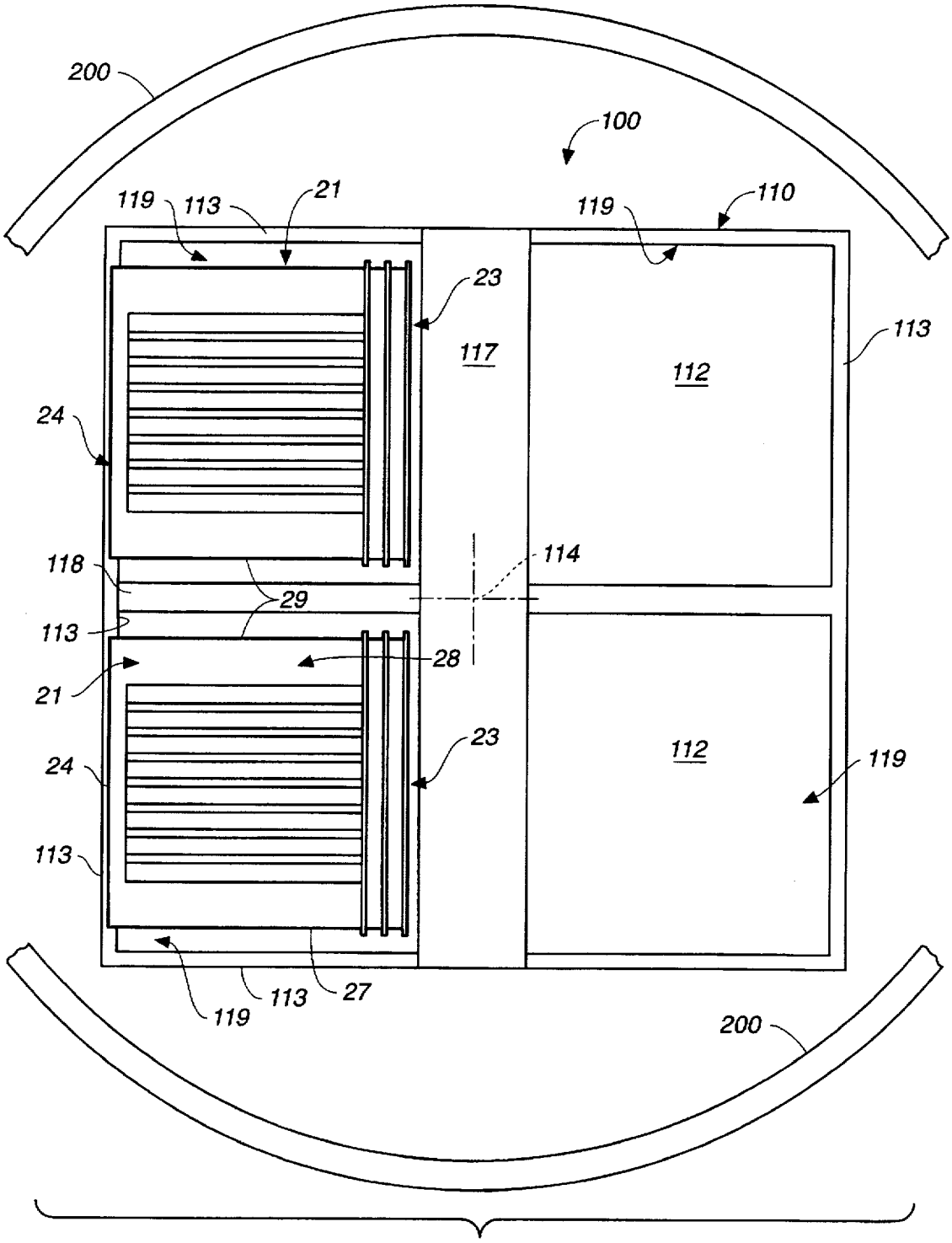
FIG. 2 is a top plan view of a centrifugal drying apparatus constructed in accordance with present invention with two baskets removed.
Figure 3:
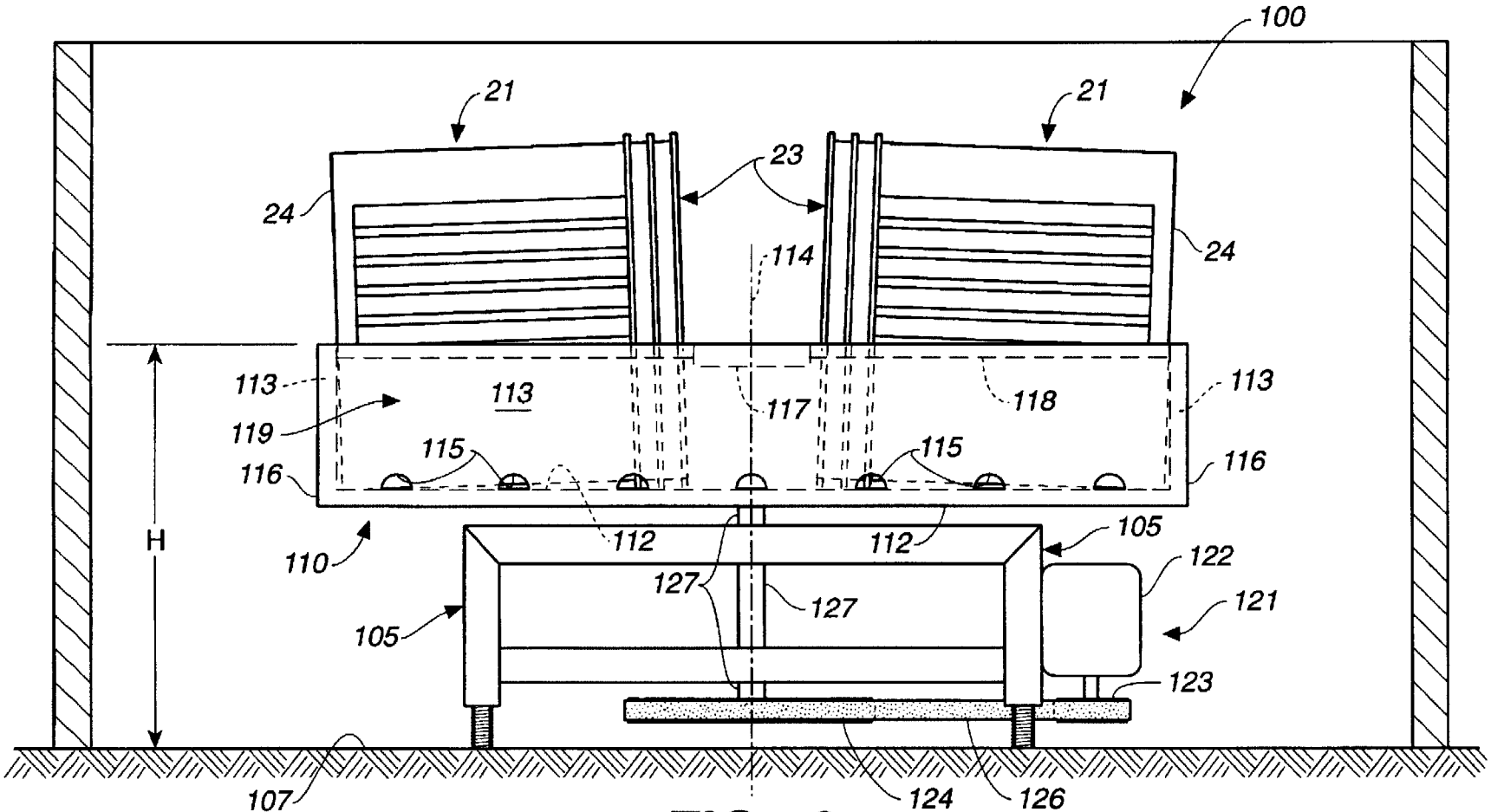
FIG. 3 is a side elevation view of the FIG. 2 drying apparatus.

As is best seen in FIG. 2, a spin dryer, generally designated 100, is provided which operates to centrifugally spin dry produce while such produce is still in its packing basket 21. Baskets containing washed produce are carried, hand-placed or automatically loaded into centrifugal spin dryer 100. As is best seen in FIGS. 2 and 3, dryer 100 has a stationary support structure 105 to which a turntable assembly, generally designated 110, is mounted for rotation about a spin axis 114. Support structure 105 can take any form and can be integrated into the processing facility building. As shown in FIG. 3, support structure 105 is an open framework which allows dryer 100 to be moved on surface 107 to virtually any desired location in the processing facility.

Turntable assembly 110 similarly can take several forms. It advantageously includes a planar, horizontally extending basket support member 112 and a vertically extending basket-securing structure 113. Securing structure 113 can extend vertically from horizontal member 112 proximate a periphery 116 of the support member. Intermediate transversely extending members 117 and 118 define a plurality of open-topped bays or recesses 119 which are dimensioned to receive produce baskets 21.

As best may be seen in FIG. 3, it is preferable that support structure 105 and basket-securing structure 113 have a combined vertical height, H, above surface 107 which allows a worker to easily lift filled produce baskets 21 into and out of bay 119 on turntable assembly 110.

The combination of horizontal support member or table 112 and vertically extending side walls or flanges 113 causes produce baskets 21 filled with produce 22 to be gravitationally and centrifugally releasably mounted and secured to the turntable assembly. Thus, the height of retainer or securement walls 113 should be selected so that centrifugal forces cannot throw the produce baskets off the turntable, but as seen in FIG. 3, walls 113 do not have to be full height of baskets 21. Walls or flanges 113 are desirably perforated at 115 or open so as to allow the free centrifugal flow of water from baskets 21 off of the turntable assembly.

It is also possible, but not necessary, to secure baskets 21 in bays 119 by a fastening device, such as a bungee cord, a hook or a latch structure. If such securement devices are employed, turntable 112 can eliminate peripheral side wall 113. The advantage of providing bays 119 without latching devices obviously is that produce baskets can be loaded and unloaded more easily from dryer 100. Horizontal support 112 also is desirably perforated or open for the granulation of water from the turntable assembly.

In order to power dryer 100, a drive assembly, generally designated 121 is operably coupled to turntable 110. Drive assembly 121 can include a motor 122, drive pulleys 123 and 124, belt 126, and drive shaft 127. Motor 122 will include a controller formed to enable selection and variation of the turntable speed, and drive assembly 121 will include such bearing and gear reduction devices as are commonly employed in industrial drive trains.

Typically, turntable 110, and the baskets resting upon it, are rotated at a speed of between about 80 to about 110 RPM for a period of 4 to 6 minutes to dry leafy vegetables, such as leaf lettuce. This angular velocity produces a centrifugal force which quickly and efficiently pulls excess water off of the vegetables in baskets 21, drying said vegetables. The optimal operating ranges of speed and duration of rotation, however, are adjustable for each type of vegetable dried by the system. It is essential, however, when setting these operational parameters that neither is set too high since extreme drying will dehydrate the leaves of the plants and may cause damage.

An important feature of the present invention, which allows modest spin rates and low spin times, is that produce baskets 21 are spun while laying on their sides. In particular, they are oriented such that perforated bottom 24 of baskets 21 is positioned to face outwardly away from spin axis 114, as shown in FIGS. 2 and 3. In this way, the vegetables are not able to fly out of open top 23 of the baskets during centrifugal spinning, and more importantly, the longitudinal axes of the produce are oriented to extend away from spin axis 114, with stems 31 positioned away from the spin axis to support the centrifugal load. The uniform or parallel orientation of the pieces of produce in the general direction of the centrifugal forces allows water to escape from the produce and baskets more easily. Leafy vegetables, for example, are all placed in a vertical orientation in the baskets 21 at the time of their harvest in the field or at the processing facility. Baskets 21, however, are releasably supported in turntable bays 119 on their sides, which causes the vegetable leaves to be facing horizontally during the drying process. During centrifugal spinning, therefore, the excess moisture found on the leaves will tend to be forced to run down the leaves toward the stems and out perforated bottom wall 24 of baskets 21. If the produce had been spun while the leaves were vertically oriented, the same centrifugal effect would tend to cause the excess moisture to migrate or move horizontally more slowly from produce piece to produce piece, making drying much less efficient. Accordingly, placing produce baskets 21 on their sides when spin drying vertically oriented vegetables in them reorients the vegetables into a horizontal plane and provides an easier and more energy efficient method of removing excess moisture from the produce.

It will be understood, however, that produce pieces 22 could be initially placed into baskets 21 in a horizontal stacked relationship with stems 31 proximate one of side walls 26, 27, 28 or 29. Since these side walls also are typically open or perforated, baskets 21 could then be placed on turntable 110 with their bottom walls 24 resting on member 112 and the wall having stems 31 proximate thereto facing away from spin axis 114. This approach would require a closure device for baskets 21 so that produce was not centrifugally ejected from the baskets, but it would orient the pieces of produce in a generally perpendicular plane to spin axis 114. Centrifugal forces, therefore, would again cause water to move along the length of the produce relatively efficiently and out the perforated side wall, and stems 31 would be in an outermost position to support centrifugal loading of the pieces 22 of produce.

A further advantage of supporting baskets 21 on a side thereof can be seen in FIG. 1 in which the ribs 29 proximate open top 23 will be seen to cause the baskets to tilt slightly on a planar support surface such as turntable support member 112. This insures that the uppermost pieces 22 of produce will not tend to fall out of basket 21.

While employing manually liftable produce baskets, the dryer of the present invention is able to dry a large quantity of vegetables simultaneously. As will be seen from FIGS. 2 and 3, dryer 110 is formed for releasable securement of a plurality of manually liftable produce baskets 21 thereto so that simultaneous drying of several baskets can take place. In FIGS. 2 and 3 a four-bay turntable 110 is shown, but it will be understood that larger turntables are also suitable for use in the present invention. It is preferable that the produce baskets be secured to turntable 110 in a manner which produces substantial dynamic balancing about spin axis 114, for example, by symmetrically arranging baskets 21 around axis 114.

As will be seen from FIG. 2, the baskets do not have to extend radially from spin axis 114, but radial arrays also are possible. As the diameter of turntable 110 increases to accommodate simultaneous drying of more baskets, space availability in processing facilities may be more efficiently used by provided multiple basket layers.

Figure 4:
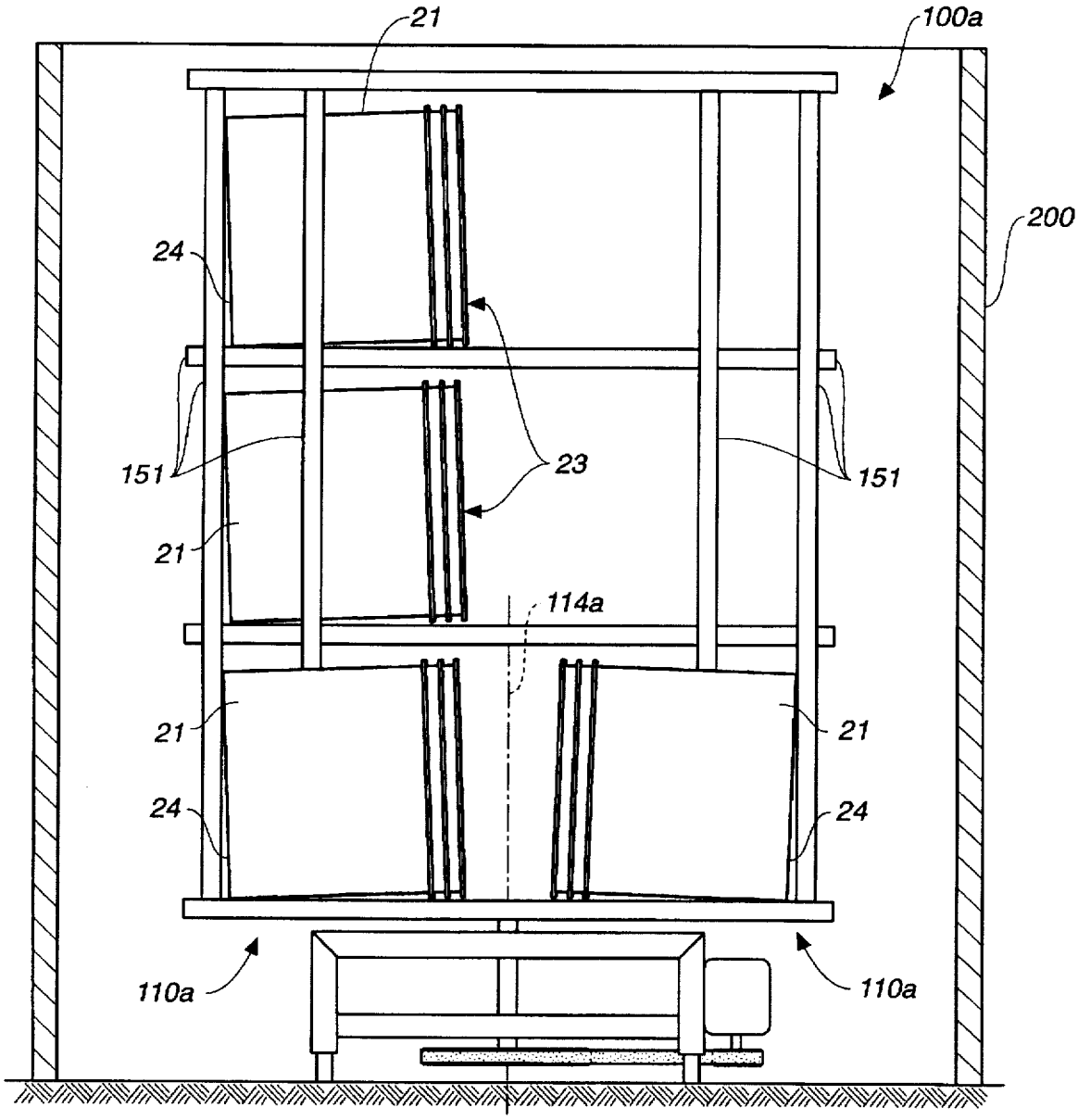
FIG. 4 is a side elevation view of an alternative embodiment of the dryer of the present invention.

As can be seen in FIG. 4, therefore, another embodiment of the present dryer is shown in which a plurality of layers or levels of baskets 21 are provided. This vertical stacking of baskets 21 allows spin dryer **100*a* to hold a much greater number of baskets in the same floor space. Typically, these baskets are stacked four high such that produce in sixteen baskets 21 can be dried simultaneously. Baskets 21 are held in position in dryer 100*a* by a framework or plurality of supports 151 which extend upwardly from base platform 110*a* and provide additional horizontal support surfaces for the baskets. Support framework 151 holds baskets 21 firmly in position when base platform 110*a* is rotating. As such, they restrain the baskets from moving away from spin axis 114*a* during the centrifugal spin drying process. As was the case with the embodiment of FIGS. 2 and 3, baskets 21 on dryer 100*a* are preferably oriented with their bottom walls 24 facing away from spin axis 114 and their open tops 23 facing inward toward spin axis 114**.

An optional containment wall 200 surrounds dryers 100 and **100*a* such that when water is forced out of the bottom of the baskets by the centrifugal effect, it is prevented from spraying haphazardly in all directions. Rather, wall 200 provides an imperforate surface which contains this water. Water run-off from wall 200** can be drained away from the dryer through a drain (not shown).

Having described the produce drying apparatus of the present invention, the present drying method can be set forth.

As is conventionally done, the first step in the present centrifugal produce drying method is to place pieces 22 of produce in a produce basket 21 having a size suitable for lifting by a single worker when the basket is full of produce. The placing step may take place in the field, a processing plant or a commercial kitchen, but most advantageously it takes place at the time of field harvesting.

Instead of using field basket 21 merely as a transport device, in the present method, the next step is to releasably secure produce basket 21 to a rotatable turntable assembly 110, 110a, while pieces 22 of produce still remain contained in basket 21. Thus, once placed in basket 22, in the present method the produce is dried while in basket 22 by securing the basket to a rotatable turntable.

The final step is to rotate the turntable assembly until centrifugal forces urge water in the produce out of the produce and through a perforated wall 24 of produce basket 21.

While the present method is effective when produce pieces 22 are randomly oriented in basket 21, it is more efficient when produce pieces are oriented in parallel planes, and during the step of securement of basket 21 to turntable 110, the baskets are oriented to cause such planes to be perpendicular to the turntable spin axis 114. Thus, in the most preferred form of the method produce is placed in baskets 21 through open top 23 in a stacked near vertical orientation and then basket 21 is secured to turntable 110 on its side to place produce pieces 22 in a near horizontal orientation which is perpendicular to the near vertical spin axis 114.

Finally, the present method contemplates releasably securing a plurality of baskets 21 to turntable 110 to increase drying capacity and balance the turntable dynamically.

What is claimed is:

1. An apparatus for centrifugal drying of produce comprising:

(a) a plurality of produce baskets each formed to receive and contain produce therein and each having a size suitable for manual manipulation by a single worker, said produce baskets further each having a perforated bottom wall adapted to contain produce therein while enabling the passage of water therethrough;

(b) a stationary support structure;

(c) a turntable assembly rotatably mounted to said support structure for rotation about a spin axis, said plurality of produce baskets each oriented to be resting on one downwardly-facing side with the one downwardly-facing side being directly in contact with and releasably secured to said turntable assembly with said perforated bottom wall of each of said produce baskets oriented to face away from said spin axis; and (d) a drive assembly operably coupled to said turntable assembly to rotate said turntable assembly at an angular velocity sufficient to centrifugally dry produce contained in said baskets.

2. The apparatus as defined in claim 1 wherein, said turntable assembly is formed for securement of said plurality of produce baskets thereto in a substantially balanced orientation about said spin axis for dynamic balancing of said turntable assembly.

3. The apparatus as defined in claim 1 wherein, said turntable assembly includes a substantially horizontally extending support member and a substantially vertically extending basket-securing structure proximate a peripheral edge of said support member, said basket-securing structure and support member securing said produce baskets to said turntable assembly by a combination of gravitational and centrifugal forces.

4. The apparatus as defined in claim 3 wherein, said support member and said basket-securing structure define an open top turntable assembly, and said open top of said turntable assembly is positioned at a vertical height above the ground sufficiently low to enable a worker to lift said produce baskets when filled with produce into and out of said turntable assembly.

5. The apparatus as defined in claim 4 wherein, said basket-securing structure is provided by a vertically upwardly extending flange at a periphery of said support member and transversely extending members spaced above said support surface and defining with said flange a plurality of basket-receiving upwardly opening bays.

6. The apparatus as defined in claim 1 wherein, said perforated wall is provided by a bottom wall of each of said produce baskets; and said spin axis is substantially vertically oriented and said turntable assembly is substantially horizontally oriented and formed with basket-securing structures releasably securing and supporting each of said produce baskets with a side thereof resting on said turntable assembly and the bottom wall thereof facing away from said spin axis in a near vertical plane.

7. The apparatus as defined in claim 6 wherein, said plurality of produce baskets each have open tops to receive produce therein.

8. The apparatus as defined in claim 7, and a plurality of elongated pieces of produce stacked in each of said produce baskets with a long axis thereof oriented to extend substantially from the open top of each produce basket toward the perforated bottom wall of each produce basket.

9. The apparatus as defined in claim 7, and a plurality of pieces of leafy vegetable stacked in each of said produce baskets oriented in planes substantially perpendicular to said spin axis.

10. The apparatus as defined in claim 7 wherein, each of said plurality of produce baskets is further formed with perforated side walls.

11. The apparatus as defined in claim 7 wherein, said turntable assembly is formed by a horizontal support surface; and said produce baskets each have a laterally projecting rib proximate said open top causing said produce baskets to be supported on said support surface with said open top tilted slightly upwardly.

12. The apparatus as defined in claim 1 wherein, said turntable assembly is adapted to simultaneously receive and securely hold four produce baskets in side-by-side pairs on opposite sides of said spin axis.

13. The apparatus as defined in claim 1 wherein, said turntable assembly is adapted to simultaneously receive and securely hold a plurality of vertically stacked produce baskets.

14. The apparatus as defined in claim 13 wherein, said perforated wall is provided by a bottom wall of each said produce basket; and said stacked produce baskets are oriented with said bottom wall of said produce basket each facing away from said spin axis.

15. The apparatus as defined in claim 1 further comprising, a containment tank surrounding said turntable assembly and formed for containing water spraying radially from said produce baskets during spinning of said turntable assembly.

* * * * *